US008215251B2

(12) United States Patent
Welsch et al.

(10) Patent No.: US 8,215,251 B2
(45) Date of Patent: Jul. 10, 2012

(54) UNDERGARMENTS HAVING FINISHED EDGES AND METHODS THEREFOR

(75) Inventors: David Welsch, Livingston, NJ (US); Anthony Angelino, Edmond, OK (US); Ronald Boser, Port St. Lucie, FL (US)

(73) Assignee: Cupid Foundations, Inc., New York, NY (US)

( * ) Notice: Subject to any disclaimer, the term of this patent is extended or adjusted under 35 U.S.C. 154(b) by 299 days.

(21) Appl. No.: 12/221,516

(22) Filed: Aug. 4, 2008

(65) Prior Publication Data

US 2008/0295227 A1 Dec. 4, 2008

Related U.S. Application Data

(63) Continuation of application No. 11/799,849, filed on May 3, 2007, which is a continuation of application No. 10/826,195, filed on Apr. 15, 2004, now Pat. No. 7,228,809.

(51) Int. Cl.
*D05B 23/00* (2006.01)
*D05B 35/00* (2006.01)
*D06C 25/00* (2006.01)

(52) U.S. Cl. ..... 112/440; 112/153; 156/88; 156/181; 2/401

(58) Field of Classification Search ..... 112/475.08, 112/475.09, 475.14, 153, 416, 406, 122, 112/475.24; 2/114, 409, 274, 275, 240, 272, 2/400, 401; 450/143, 81; 156/91, 93, 94, 156/148, 249, 73.1, 73.3, 305, 181, 88; 604/385.25, 604/385.31; 428/47, 192, 193, 194
See application file for complete search history.

(56) References Cited

U.S. PATENT DOCUMENTS

| | | | |
|---|---|---|---|
| 567,948 | A | 9/1896 | Bracher |
| 1,707,611 | A | 4/1929 | Hamburger et al. |
| 1,793,630 | A | 2/1931 | Miller |
| 2,172,251 | A | 9/1939 | Copeman |
| 2,268,399 | A | 12/1941 | Hurt |
| 2,425,479 | A | 8/1947 | Le Blanc |
| 2,514,108 | A | 8/1947 | Vogt |

(Continued)

FOREIGN PATENT DOCUMENTS

GB 2316353 2/1998

(Continued)

OTHER PUBLICATIONS

Garment shown by Applicants to a customer more than one year prior to Apr. 15, 2004, the filing date of the grandparent application, which has now issued as U.S. Patent No. 7,228,809.

(Continued)

*Primary Examiner* — Ismael Izaguirre
(74) *Attorney, Agent, or Firm* — Lerner, David, Littenberg, Krumholz & Mentlik, LLP

(57) ABSTRACT

An undergarment includes at least one piece of fabric that forms the undergarment. The undergarment has leg openings. The fabric includes edges that surround the leg openings, whereby at least one of the edges surrounding the leg openings has a plurality of fibers and at least some of the fibers have free ends terminating at the at least one of the edges surrounding the leg openings. A bead of a cured polymer is disposed over the at least one of the edges surrounding the leg openings. The cured polymer bead forms a finished edge that is stretchable for adjusting to movement of the fabric.

11 Claims, 15 Drawing Sheets

U.S. PATENT DOCUMENTS

| | | | | |
|---|---|---|---|---|
| 2,579,547 | A | | 12/1951 | Cadous |
| 2,619,089 | A | | 11/1952 | Swartz |
| 2,728,919 | A | | 1/1956 | Booth |
| 2,740,457 | A | | 4/1956 | Wood et al. |
| 2,809,673 | A | * | 10/1957 | McMurray ..... 139/423 |
| 2,842,509 | A | | 7/1958 | Shannon |
| 3,137,864 | A | | 6/1964 | Ostmann |
| 3,203,381 | A | | 8/1965 | Crane et al. |
| 3,226,275 | A | | 12/1965 | Kiess |
| 3,316,117 | A | | 4/1967 | Clifford et al. |
| 3,367,810 | A | | 2/1968 | Wasserstein |
| 3,559,650 | A | | 2/1971 | Larson |
| 3,571,814 | A | | 3/1971 | Miller |
| 3,599,640 | A | | 8/1971 | Larson |
| 3,632,383 | A | | 1/1972 | Dominick et al. |
| 3,703,730 | A | | 11/1972 | Miller |
| 3,755,033 | A | | 8/1973 | Emus |
| 3,800,331 | A | * | 4/1974 | Taddeo ..... 2/240 |
| 3,810,810 | A | | 5/1974 | Bylund |
| 3,856,599 | A | | 12/1974 | Bylund |
| 3,899,949 | A | | 8/1975 | Bystron et al. |
| 3,923,049 | A | | 12/1975 | Lauber et al. |
| 3,944,388 | A | | 3/1976 | Getchell |
| 3,978,259 | A | | 8/1976 | Hilton et al. |
| 4,109,042 | A | | 8/1978 | Estes et al. |
| 4,141,869 | A | | 2/1979 | Hoss et al. |
| 4,186,043 | A | | 1/1980 | Zeigler, Jr. et al. |
| 4,249,267 | A | | 2/1981 | Voss |
| 4,300,968 | A | | 11/1981 | Fottinger et al. |
| 4,496,407 | A | | 1/1985 | Lowery, Sr. et al. |
| 4,560,427 | A | | 12/1985 | Flood |
| 4,569,870 | A | | 2/1986 | Shinmi |
| 4,596,616 | A | | 6/1986 | Noda et al. |
| 4,889,576 | A | | 12/1989 | Suganuma et al. |
| 4,917,937 | A | | 4/1990 | Lappanen et al. |
| 5,036,838 | A | | 8/1991 | Sherman |
| 5,085,917 | A | | 2/1992 | Hodnett, III |
| 5,124,111 | A | | 6/1992 | Keller et al. |
| 5,124,190 | A | | 6/1992 | Isoe et al. |
| 5,403,644 | A | | 4/1995 | Fujisawa et al. |
| 5,422,166 | A | | 6/1995 | Fleischer |
| 5,497,513 | A | | 3/1996 | Arabeyre et al. |
| 5,506,033 | A | | 4/1996 | Smith |
| 5,531,176 | A | | 7/1996 | Johnson |
| 5,539,900 | A | | 7/1996 | Matsui et al. |
| 5,718,966 | A | | 2/1998 | Gray et al. |
| 5,731,059 | A | | 3/1998 | Smith et al. |
| 5,864,956 | A | | 2/1999 | Dong |
| 5,885,910 | A | | 3/1999 | Graichen |
| 5,932,284 | A | | 8/1999 | Reynolds |
| 5,948,707 | A | | 9/1999 | Crawley et al. |
| 5,981,034 | A | | 11/1999 | Gray et al. |
| 6,059,834 | A | | 5/2000 | Springs |
| 6,163,969 | A | | 12/2000 | Jan et al. |
| 6,167,630 | B1 | | 1/2001 | Webb |
| 6,230,416 | B1 | | 5/2001 | Trigilio |
| 6,293,024 | B1 | | 9/2001 | Fiebig et al. |
| 6,308,428 | B1 | | 10/2001 | Creighton, III |
| 6,332,825 | B1 | | 12/2001 | Henricksen |
| 6,446,268 | B1 | | 9/2002 | Lazarian |
| 6,453,568 | B1 | | 9/2002 | Hymer |
| 6,482,167 | B2 | | 11/2002 | Grim et al. |
| 6,493,955 | B1 | | 12/2002 | Moretti et al. |
| 6,503,602 | B1 | | 1/2003 | Crosby |
| 6,517,651 | B2 | | 2/2003 | Azulay |
| 6,532,676 | B2 | | 3/2003 | Cunningham |
| 6,630,043 | B2 | | 10/2003 | Sloot |
| 6,689,517 | B1 | | 2/2004 | Kaminsky et al. |
| 6,704,942 | B2 | | 3/2004 | Lazarian |
| 6,797,352 | B2 | | 9/2004 | Fowler |
| 6,827,806 | B2 | | 12/2004 | Uitenbroek et al. |
| 7,228,809 | B2 | | 6/2007 | Angelino et al. |
| 7,404,819 | B1 | * | 7/2008 | Darios et al. ..... 606/151 |
| 7,607,964 | B2 | * | 10/2009 | Mone et al. ..... 450/27 |
| 2001/0049879 | A1 | | 12/2001 | Moore |
| 2002/0017362 | A1 | | 2/2002 | Covert et al. |
| 2002/0078578 | A1 | | 6/2002 | Allen |
| 2002/0166249 | A1 | | 11/2002 | Liao |
| 2002/0184774 | A1 | | 12/2002 | Kim et al. |
| 2003/0017772 | A1 | | 1/2003 | Sloot |
| 2003/0029048 | A1 | | 2/2003 | Huang et al. |
| 2003/0106226 | A1 | | 6/2003 | Tacklind et al. |
| 2007/0204782 | A1 | | 9/2007 | Angelino et al. |
| 2008/0295227 | A1 | | 12/2008 | Welsch et al. |

FOREIGN PATENT DOCUMENTS

| | | |
|---|---|---|
| JP | 6170063 | 6/1994 |
| JP | 7101302 | 4/1995 |
| JP | 7133502 | 5/1995 |
| JP | 8226071 | 9/1996 |
| JP | 2001192962 | 7/2001 |
| JP | 2002129404 | 5/2002 |
| JP | 2003253510 | 9/2003 |

OTHER PUBLICATIONS

*Cupid Foundations, Inc.,* v. *Jupi Corporation*, United States District Court for the District of New Jersey, Civil Action No. 07-cv-05506, Defendant Jupi's Amended Responses and Objections to Plaintiff Cupid's First Set of Interrogatories (1-16), Aug. 11, 2008.

*Cupid Foundations, Inc.,* v. *Jupi Corporation*, United States District Court for the District of New Jersey, Civil Action No. 07-05506 (JLL) Order, 2 pages, Sep. 17, 2009.

* cited by examiner

UNDERGARMENTS HAVING FINISHED EDGES AND METHODS THEREFOR

CROSS REFERENCE TO RELATED APPLICATIONS

This application is a continuation of U.S. application Ser. No. 11/799,849, filed May 3, 2007, which is a continuation of U.S. application Ser. No. 10/826,195, filed Apr. 15, 2004, now U.S. Pat. No. 7,228,809, the disclosures of which are hereby incorporated herein by reference.

BACKGROUND OF THE INVENTION

The present invention relates to manufacturing garments and particularly relates to methods for making garments having finished edges.

Most garments are made by cutting fabric into pattern pieces and then sewing the cut pattern pieces together to make the garment. Typically, each cut pattern piece has one or more edges that are sewn to the edges of one or more adjacent cut pattern pieces, which forms a seam between the cut pattern pieces. The outer edges of the garment, however, are not sewn to the edges of other cut pattern pieces. As a result, the outer edges are exposed to forces that may fray or tear the fabric. In response to the tearing and fraying problem, the clothing industry has developed methods for finishing the edges of garments, including using narrow elastic, lace, trim and/or a folded over edge. The clothing industry also uses fabric having a knitted-in edge. Although this particular type of fabric provides garments having smoother edges, its use results in relatively low material yields.

The most common method for finishing the edge of a cut pattern piece involves using narrow elastic. Referring to FIG. 1A, a cut pattern piece 20 is made of cotton, nylon, polyester, or spandex fibers or any other natural or synthetic fibers commonly used to make garments. As shown in FIGS. 1A and 1B, the cut pattern piece 20 has an outer edge 22 and includes a plurality of fibers 26 having free ends 28 that terminate at the edge 22. As is well known to those skilled in the art, the free ends 28 of the fibers 26 form a rough, outer edge that tends to fray and/or tear as the fabric is used.

In order to overcome the above-mentioned fraying problems in clothing such as activewear, shapewear and/or compression garments, most cut pattern pieces have a narrow elastic that is sewn onto the outer edge 22. Referring to FIGS. 2A-2C and 3A-3C, a cut pattern piece 20 has a rough, outer edge 22 with fibers having ends (not shown) that terminate at the edge. Referring to FIGS. 2A and 3A, a narrow elastic 23 is aligned over a top surface 30 of the cut pattern piece 20. Referring to FIGS. 2B-1, 2B-2 and 3B, a flap 25 of fabric adjacent outer edge 22 is folded over the top surface 30 and the narrow elastic is positioned over the flap 25. Referring to FIGS. 2B-2, 2C and 3C, the flap 25 and the narrow elastic 23 are held in place by stitching 32 for forming a finished edge 34 on the cut pattern piece. The finished edge including the flap 25 and the narrow elastic 23 has a thickness $H_1$ that is substantially greater than the thickness $H_2$ of the original cut pattern piece 20. As a result, the finished edge is bulky and is likely to be visible through outerwear.

As noted above, in most garments, the finished edge is made using a narrow elastic. In some garments, however, the finished edge is made using lace, a fold-over edge, or trim, with and without using a narrow elastic. The presence of the bulky edge (FIG. 2C) is not desirable, particularly when the fabric is used for producing garments such as activewear, shapewear, garments having one or more support panels and garments using compression fabric. The presence of a bulky finished edge is particularly undesirable when the fabric is to be used in undergarments and bathing suits. This is because the finished edge, as shown in FIG. 2C, adds unwanted bulkiness to the garment. For example, a bulky finished edge on an undergarment is undesirable because it may, inter alia, be seen through clothing worn over the undergarment. The bulky finished edge is also less stretchable, so that it will not readily adjust to a wearer's body. This will cause the garment to ride-up and bind to a wearer, causing discomfort.

The clothing industry has also developed fabrics having knitted-in edges, whereby relatively complex stitching is used at the edges to avoid the fraying and tearing problems described above. Although garments having knitted-in edges are smoother than garments that use narrow elastic, lace and/or trim, making the fabric for the garments is more expensive. This is because a knitted-in edge requires complex knitting that adds to the cost of making the fabric. In addition, the knitted-in edge provides limitations that adversely affect material yield.

Referring to FIG. 4, a spread 20 has a knitted-in finished edge 34 formed along a lower edge thereof. The knitted-in finished edge may also have rubber fibers that are knitted into the fabric to provide gripping to increase the hold of the garment to the body. The spread 20 has a length designated L and a width designated W. In the particular example shown in FIG. 4, the spread has a length L of 252 inches and a width W of 26 inches. A pattern is then used to define a series of pattern pieces 38A-38F. An automatic cutting machine or hand-cutting tool may then be used to cut the pattern pieces 38A-38F. Due to the requirement that each cut pattern piece have a portion of the knitted-in finished edge 34 incorporated therein, only one pattern piece may be cut from each of the respective panels 40A-40F of spread 20. As a result, the fabric in each panel section 40A-40F that is not part of one of the cut pattern pieces 38A-38F is waste material. As is well known to those skilled in the art, wasting material from a spread having a finished edge is undesirable and costly. In the particular spread 20 shown in FIG. 4, the material yield of the spread is 57.13% because the cut pattern pieces 38A-38F utilize 57.13% of the spread, with 42.87% of the spread being unusable waste material. This level of waste is undesirable in the highly competitive and cost-conscious garment industry.

In view of the above-described problems, there is clearly a need for garments having finished edges that are not bulky. There is also a need for garments having finished edges that can grip and that do not ride-up over a wearer's body to cause binding. There is also a need for garments having finished edges that are smooth and that do not show through outer garments. Furthermore, there is a need for methods of making garments that improve material yield and reduce waste.

SUMMARY OF THE INVENTION

In certain preferred embodiments of the present invention, a method of making a fabric having a finished edge includes providing a fabric having a plurality of fibers with free ends of the fibers at an edge of the fabric and disposing a curable polymer over the edge of the fabric so that the curable polymer engages the free ends of the fibers at the edge of the fabric. The method desirably includes, after the disposing step, curing the polymer for binding the free ends of the fibers at the edge of the fabric to the cured polymer. In preferred embodiments, the fabric may be made of cotton, nylon, polyester and spandex fibers or any other natural or synthetic fibers used to make fabric. In certain preferred embodiments, the fabric is cut into pattern pieces before the curable polymer material is disposed on the fabric. Each cut pattern piece may be sewn to one or more other pieces of fabric for making a garment. Although the present invention is not limited by any particular theory of operation, it is believed that cutting the pattern pieces before forming the finished edge will dramatically improve the material yield from a spread, particularly in comparison to techniques using fabric having knitted-in edges. This particular feature will be described and shown in more detail below in FIG. 5 of the present application.

Prior to disposing the polymer material, an edge of the cut pattern piece is desirably positioned over an absorbent material, such as a sheet of absorbent paper. In one preferred embodiment, the absorbent paper is a roll of elongated paper that is unrolled onto a conveyor system, with the paper provided on a top surface of the conveyor, between the cut pattern piece and the conveyor. In certain preferred embodiments, at least the edge of the cut pattern piece is in contact with the absorbent material as the polymer is deposited onto the cut pattern piece. Although not limited by any particular theory of operation, it is believed that the absorbent material acts as a shield that prevents the polymer material from coming in direct contact with the conveyor. This shielding action avoids the need to clean or remove polymer from the conveyor. The absorbent material may also assist in the formation of a clean edge of cured polymer material at the edge of the pattern piece.

In certain preferred embodiments, the polymer includes silicone. As is well known to those skilled in the art, a silicone is defined as any one of a large group of siloxanes that are stable over a wide range of temperatures. More specifically, silicones are any of a group of semi-inorganic polymers based on the structural unit $R_2SiO$, where R is an organic group, characterized by wide-ranging thermal stability, high lubricity, extreme water repellence and physiological inertness. Silicones are typically used in lubricants, adhesives, coatings, paints, synthetic rubber, electrical insulation and prosthetic replacements for body parts. In one particularly preferred embodiment, the silicone is a compound made up of, by weight, approximately 10-30% silica and 60-90% vinylpolydimethylsiloxane.

The method also desirably includes aligning the edge of the cut pattern piece with a dispenser for the curable polymer and dispensing the curable polymer from the dispenser onto the edge of the cut pattern piece. In certain preferred embodiments, the dispenser includes at least one opening for dispensing the curable polymer. In other preferred embodiments, the dispenser includes a series of openings for dispensing the curable polymer, at least one of the openings having a different size than at least another one of the openings.

After the polymer has been deposited on the cut pattern piece, the polymer is desirably cured using heat. In one preferred embodiment, one or more heating stations are provided for heating the polymer material previously applied to the cut pattern piece. The cut pattern piece may be placed in thermal communication with the one or more heating elements. In one preferred embodiment, the cut pattern piece may be moved on a conveyor element, such as a conveyor belt, with the absorbent material positioned atop the conveyor and the fabric positioned at least partially on the absorbent material. Each heating station may have one or more heating elements for generating heat. The temperature of the polymer and/or the temperature of the cut pattern pieces may be monitored to insure that the polymer is heated to an adequate temperature to properly cure the polymer. In certain preferred embodiments, the polymer is heated to approximately 260-280 degrees Fahrenheit. In more preferred embodiments, the polymer is heated to approximately 265-275 degrees Fahrenheit. The time limit for heating the polymer may vary. In one preferred embodiment, heating for about one minute cures the polymer on the cut pattern piece.

The conveyor element may have a top surface for supporting the cut pattern pieces. In one preferred embodiment, the conveyor element may include a conveyor belt having a top surface for supporting the cut pattern pieces as the pieces move between various stations, i.e. alignment station, disposing polymer station, curing station, etc. In one particular preferred embodiment, the top surface of the conveyor belt may include a material having a low coefficient of friction or a non-stick material such as the material sold under the trademark TEFLON. As a result, there may be no need to provide an absorbent material between the pattern pieces and the conveyor because any polymer deposited on the conveyor may be easily removed from the top surface such as by using a scrapper.

The step of disposing a curable polymer on the cut pattern piece may include disposing a first polymer bead over the edge of the pattern piece and disposing at least one second polymer bead adjacent the first polymer bead. The at least one second polymer bead may be narrower than the first polymer bead. In more preferred embodiments, the at least one second polymer bead includes a plurality of second polymer beads. The at least one second polymer bead may include a plurality of second polymer beads spaced from one another, with the fabric of the pattern piece exposed between the plurality of second polymer beads. The one or more second polymer beads may extend in a direction parallel to the edge of the fabric or may extend along a path that mirrors the edge of the fabric.

In other preferred embodiments, the polymer may be provided on the pattern piece away from the edge of the pattern piece. In these embodiments, the polymer may provide gripping to prevent the fabric from riding or slipping over the body of a garment wearer. The polymer may be one or more beads that follow an S-shaped or curved pattern. The one or more polymer beads may be continuous or non-continuous, e.g. intermittent deposits of polymer on a fabric. The polymer may also be provided as polymer dots on the fabric. The intermittent polymer deposits may form a matrix of polymer on a fabric. In certain preferred embodiments, the spacing between the polymer beads may be increased for increasing the stretchability of the fabric. In other preferred embodiments, the spacing between the polymer beads may be decreased for increasing the gripping of the fabric. The polymer beads may also be applied over a central region of a fabric to provide gripping at the central region for holding the fabric in place over a body.

Another preferred embodiment of the present invention involves cutting a spread. As is well known to those skilled in the art, cutting a spread involves laying down fabric having a desired length in multiple layers. Typically, a spread may include 100 or more layers of fabric. Before cutting the spread into pattern pieces, a particular pattern is selected and applied to the spread. The pattern may be applied through a computer system that analyzes the length of the fabric and determines how to maximize the number of pattern pieces that may be cut from the fabric. The computer system may also control an automatic cutting machine for cutting the fabric into cut pattern pieces. The spread may also be cut by placing a pattern over the spread and cutting the pattern pieces by hand using a cutting tool. In one particular preferred embodiment, a method of making a cut pattern piece for a garment includes providing a spread, and cutting the spread to provide cut pattern pieces, each cut pattern piece including a plurality of fibers having free ends that terminate at an edge of the pattern piece. The method desirably includes after the cutting step, disposing a curable polymer over the edges of the cut pattern pieces so that the curable polymer engages the free ends of the fibers at the edges of the pattern pieces. After the curable polymer is disposed, the polymer is desirably cured for binding the free ends of the fibers at the edges of the pattern pieces to the cured polymer. Each pattern piece having the cured polymer edge may be sewn to at least one other piece of fabric for making the garment. The curable polymer material may be placed on the cut pattern piece by disposing a first polymer bead over the edge of the pattern piece and disposing at least one second polymer bead over the pattern piece adjacent the first polymer bead, whereby the at least one second polymer bead is narrower than the first polymer bead. The at least one second polymer bead may include a plurality of second polymer beads spaced from one another on the pattern piece with a face of the pattern piece being exposed between the plurality of second polymer beads.

In another preferred embodiment of the present invention, a section of a garment includes a cut pattern piece having a plurality of fibers with free ends that terminate at an edge of the pattern piece, and a bead of cured polymer material provided over the edge of the pattern piece, the bead of cured polymer material encapsulating at least some of the free ends of the fibers that terminate at the edge of the pattern piece. The pattern piece desirably includes a plurality of second beads of cured polymer material disposed on the pattern piece adjacent the first bead of cured polymer material, whereby the plurality of second beads are spaced from one another on the pattern piece with a face of the pattern piece being exposed between the second beads. The second beads preferably provide gripping which holds the fabric in place over a wearer's body.

The present invention provides tremendous benefits over prior art methods of making garments. Specifically, the present invention dramatically increases the material yield from fabric spreads. Prior art methods that use fabric having knitted-in edges require that the finished edge be formed on a spread before the spread is cut to make cut pattern pieces. Because the pattern pieces must be cut from the knitted-in finished edge, a large area of the spread away from the finished edge cannot be used. In contrast to these prior art methods, the present invention enables pattern pieces to be cut from any region of a spread. Thus, the cut pattern pieces do not have to incorporate a knitted-in finished edge, inter alia, because the finished edge of the present invention is preferably formed only after the pattern pieces have been cut.

The present invention also enables a spread to have more layers of fabric. When laying a spread of fabric having knitted-in edges, the knitted-in edges are thicker than the rest of the fabric. This limits the number of layers that can be stacked atop one another. Typically, a spread of fabric having knitted-in edges can only be stacked 24 or 48 layers high. In addition, fabric having knitted-in edges is also harder to handle. All of these factors slow down the process of producing pattern pieces having knitted-in edges, which adds to the cost and time needed to manufacture garments.

The present invention also provides finished edges that are sleeker and thinner than prior art products having a relatively thick finished edge. As described herein, a silicone bead that finishes an edge is much thinner than the prior art finished edges that use folded-over edges, narrow elastic, trim and/or lace. The silicone beads also provide a garment that grips for preventing the garment from riding over a wearer's body. As a result, the garment will not ride and bind (e.g. constrain). The present invention also provides a garment having stability due to the gripping from the polymer. This stability minimizes the likelihood that the fabric will roll over upon itself, which may result in bunching or binding of the garment. The present invention also provides a finished edge that has more stretch because it does not have a thick finished edge that is formed when using narrow elastic, trim, lace and/or a folded-over edge.

In another preferred embodiment of the present invention, a garment includes a cut pattern piece made of a fabric having edges and an interior region of the fabric being spaced from the edges. The fabric may include natural fibers such as cotton fibers or synthetic fibers such as nylon, polyester and spandex fibers. The garment preferably includes at least one bead of silicone deposited in the interior region of the fabric, whereby the silicone is in contact with the fabric and provides gripping for holding the cut pattern piece in place on a wearer's body. The garment may be an undergarment, activewear, shapewear, a bathing suit, a garment having one or more support panels or a garment that uses compression fabric.

In another preferred embodiment, a method of increasing material yield when cutting pattern pieces from fabric includes laying a spread of fabric having a bottom edge, cutting a plurality of pattern pieces from the spread of fabric, wherein at least some of the cut pattern pieces do not include the bottom edge of the spread of fabric, and disposing a curable polymer material such as silicone over one or more edges of the cut pattern pieces including the at least some of the cut pattern pieces that do not include the bottom edge of the spread of fabric. In this particular embodiment, the cut pattern pieces may include fibers having free ends that terminate at the one or more edges of the cut pattern pieces. The method also desirably includes curing the polymer material for finishing the one or more edges of the cut pattern pieces.

In still another preferred embodiment of the present invention, a garment includes a cut pattern piece made of a fabric with fibers having free ends terminating at an edge of the cut pattern piece, and a polymer material provided on the fabric in contact with the free ends of the fibers, whereby the polymer material provides a finished edge for the cut pattern piece. The fabric may include compression fabric or stretchable fabric such as fabric used in activewear or shapewear. The garment may be an undergarment, activewear, shapewear, a bathing suit, a garment having support panels and a garment using compression fabric. In highly preferred embodiments, the finished edge of the cut pattern piece is devoid of narrow elastic, a folded-over edge, trim and/or lace. As a result, the finished edge of the present invention is not bulky and is able to more easily stretch to adjust to various body dimensions and body movements. As a result, the garment will be less likely to bind to and ride over a wearer's body. In certain preferred embodiments, the polymer material provided on the stretchable fabric includes a first polymer bead provided in contact with the free ends of the fibers and at least one second polymer bead in contact with the fabric, the at least one second polymer bead being spaced from the first polymer bead. The at least one second polymer bead desirably provides gripping for holding the fabric in place over a wearer's body.

In yet another preferred embodiment of the present invention, a garment having a sleek finished edge includes a cut pattern piece made of fibers, at least some of the fibers having free ends that terminate at an edge of the cut pattern piece, and a cured polymer material such as silicone provided in contact with the free ends of the fibers at the edge of the cut pattern piece, the cured polymer material providing a sleek finished edge to the cut pattern piece, the finished edge being preferably devoid of a folded-over edge, narrow elastic, trim and/or lace. Due to the absence of the narrow elastic, trim or lace, the finished edge is much thinner than prior art finished edges, and is better suited for stretching, which prevents binding and ride-up.

In still another preferred embodiment of the present invention, a method of controlling a stretchable garment utilizing the stretch characteristics of stretchable fabric includes providing a spread of stretchable fabric that is more stretchable in a first axial direction and less stretchable in a second axial direction, and cutting a pattern piece from the spread, wherein the at least one cut pattern piece has unfinished edges with free ends of fibers at the unfinished edges. The method desirably includes disposing a curable polymer over one of the unfinished edges of the cut pattern piece so that the curable polymer engages the free ends of the fibers, wherein the one of the unfinished edges having the curable polymer disposed thereon extends along a third axial direction that crosses the first axial direction, and after the disposing step, curing the polymer for finishing the edge of the fabric.

The present invention provides garments that have smoother finished edges than garments that use folded-over edges, narrow elastic, trim and/or lace at the finished edge. As a result, the garments of the present invention will not have bulky finished edges. Moreover, the finished edges of the present invention are more stretchable than the finished edges of garments that use folded-over edges, narrow elastic, trim and/or lace. As a result, the finished edge of the present invention minimizes ride-up and binding. Furthermore, the smooth finished edges or the present invention are less likely to be visible through outer garments than are garments having bulky finished edges made of folded-over edges, narrow elastic, trim or lace.

The present invention also improves material yield over techniques that use fabric having knitted-in edges. This is due to the fact that the finished edge is formed after the pattern piece has been cut. As a result, the cut pattern pieces of the present invention do not need to incorporate a particular edge of a spread, such as a knitted-in edge. This enables an operator to cut pattern pieces in regions of a spread that are spaced from the edges of the spread, thereby maximizing material yield.

The present invention also improves material yield because an operator has more flexibility to cut a pattern piece from anywhere along a width of a spread. In contrast, methods using fabric with knitted-in edges must cut each pattern piece within the width of one of the panels of a spread. The smaller width of the panels versus an entire spread (20 inches v. 80-120 inches) reduces flexibility when marking patterns on fabric having a knitted-in edge, which further reduces material yield.

Moreover, the present invention saves money because it enables the production of garments having smooth finished edges without requiring the used of fabric having costly knitted-in edges. Thus, manufacturers will save money on fabric for making garments.

These and other preferred embodiments of the present invention will be described in more detail below.

BRIEF DESCRIPTION OF THE DRAWINGS

FIG. 2B-2 shows a perspective view of FIG. 2B-1.

DETAILED DESCRIPTION

Figure 4:
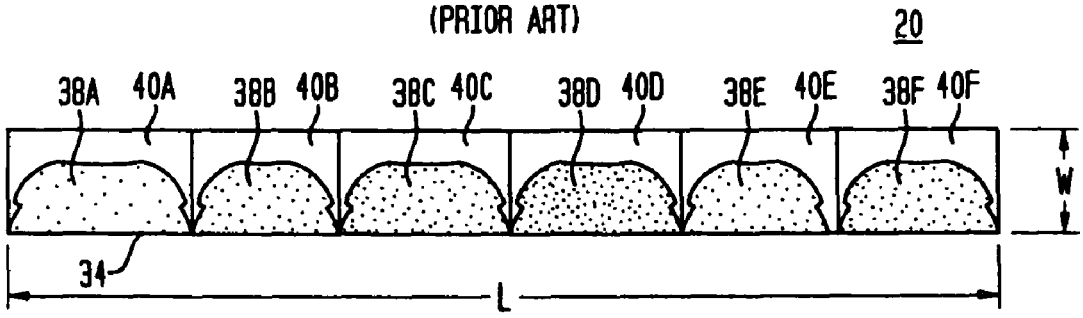
FIG. 4 (PRIOR ART)
FIG. 4 shows a conventional spread having pattern pieces defined in the spread.
Figure 5:
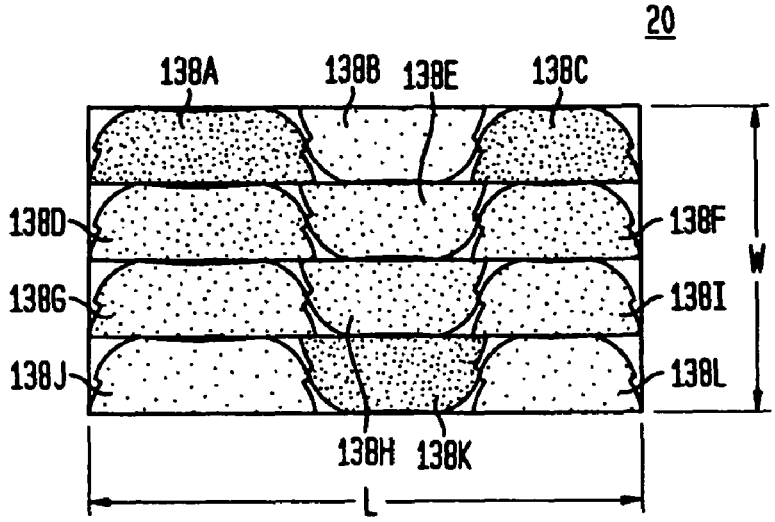
FIG. 5 shows a plan having pattern pieces defined therein, in accordance with certain preferred embodiments of the present invention.
Figure 6:
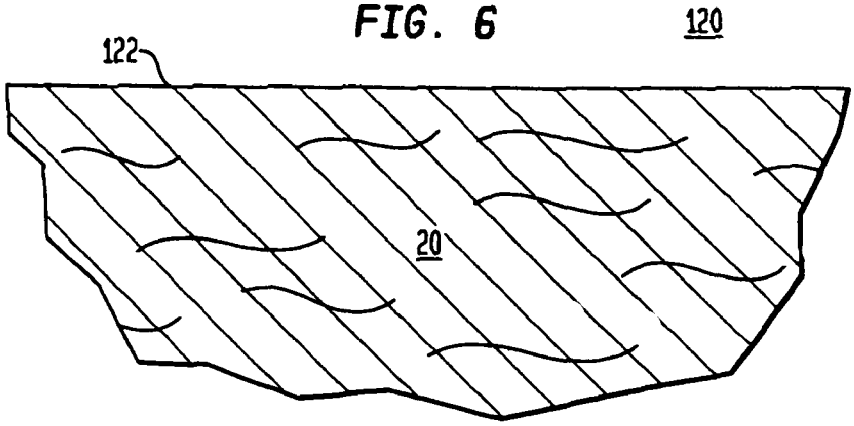
FIG. 6 shows a plan view of a cut pattern piece having an unfinished edge, in accordance with certain preferred embodiments of the present invention.

Referring to FIG. 5, in accordance with certain preferred embodiments of the present invention, a spread 120 has a length designated L and a width designated W. In the particular example shown in FIG. 4, the spread has a length L of 117.56 inches and a width W of 73.50 inches. A pattern is used to define a series of pattern pieces 138A-138L. An automatic cutting machine or hand-cutting tool may be used to cut the pattern pieces 138A-138L. Because the spread 120 has no finished edge, such as a knitted-in edge, the cut pattern pieces may include those cut from the spread at a location away from an edge of the spread. As a result, a greater percentage of the spread may be used to make cut pattern pieces, which will improve the material yield of the spread. In the particular spread 120 shown in FIG. 5, the material yield of the spread is 86.70% because the cut pattern pieces 138A-138L utilize 86.70% of the spread 120, with 13.3% of the spread being unusable waste material. The 86.70% material yield is a tremendous improvement over the 57.13% material yield described in conjunction with the FIG. 4 prior art embodiment that uses fabric having a knitted-in edge. Thus, the present invention saves money by increasing material yield. The present invention also saves money because it obviates the need to use fabric having knitted-in edges, thereby saving on the cost of materials. The present invention is also more economical because it allows more layers of fabric to be stacked in the spread (i.e. 100-200 layers) before cutting the spread, which results in more cut pattern pieces being produced at a faster rate. In contrast, a spread of knitted-in fabric can only be stacked about 24-48 layers high before cutting, because the knitted-in edge is thicker than the remaining portion of the fabric. The thicker edge makes one edge of the spread higher than the other edges of the spread.

Referring to FIGS. 6 and 7A-7C, in certain preferred embodiments of the present invention, a cut pattern piece 120 is made of a plurality of fibers 126 having free ends 128 that terminate at an edge 122 of the pattern piece. In order to prevent the free ends 128 of the fibers 126 of the pattern piece from fraying or tearing, a silicone bead is deposited in contact with a top surface 130 of the cut pattern piece 120, adjacent the edge 122 of the pattern piece.

Figure 1A:
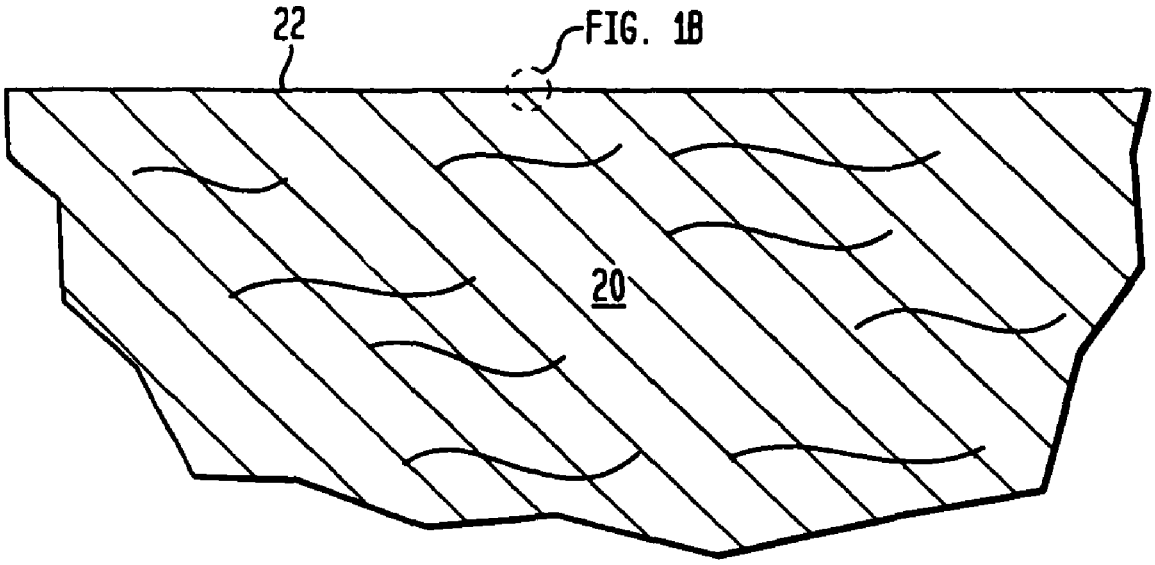
FIG. 1A shows a panel having an edge.
Figure 1B:
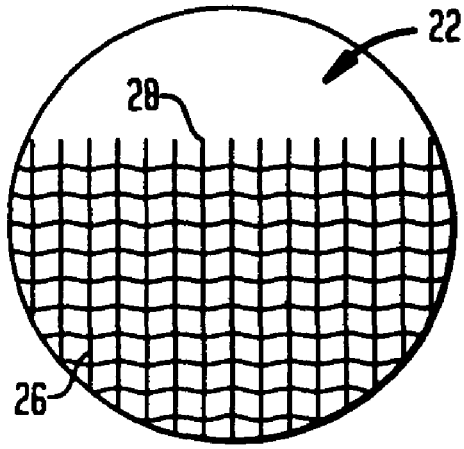
FIG. 1B shows an expanded view of the edge of the panel shown in FIG. 1A.
Figure 2A:
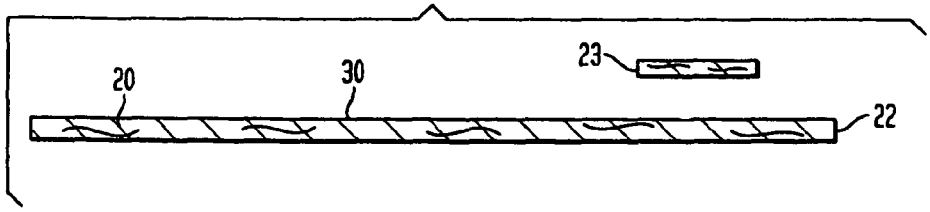
FIG. 2A (PRIOR ART)
FIGS. 2A, 2B-1, 2C and 3A-3C show a conventional method of making a finished edge on a panel.
Figures 1, 2B:
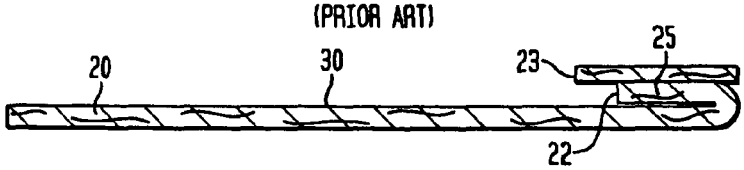
FIG. 2B-1 (PRIOR ART)
Figures 2, 2B:
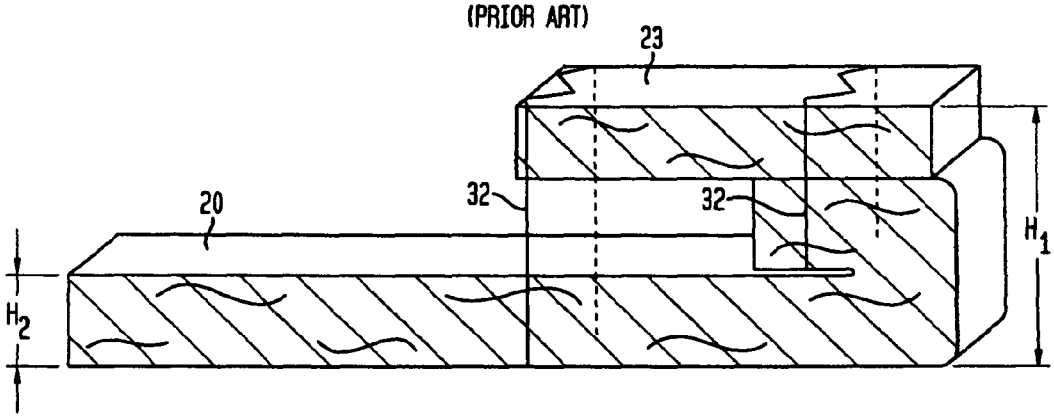
FIG. 2B-2 (PRIOR ART)
Figure 2C:
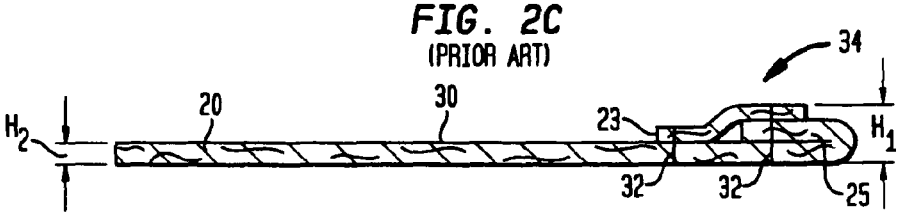
FIG. 2C (PRIOR ART)
Figure 3A:
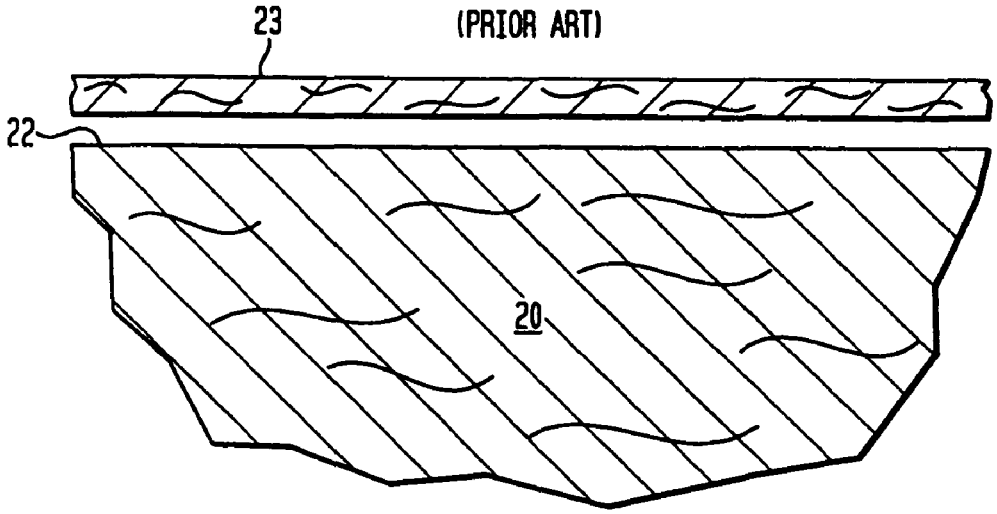
FIG. 3A (PRIOR ART)
Figure 3B:
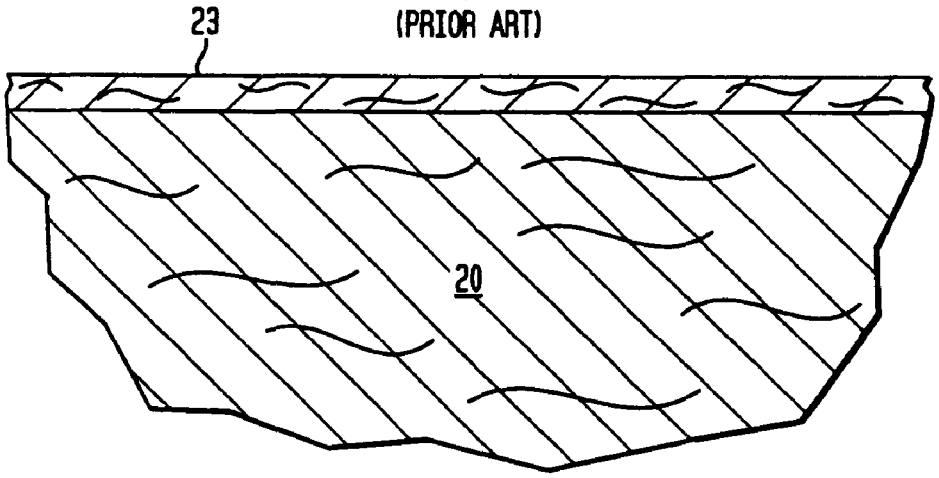
FIG. 3B (PRIOR ART)
Figure 3C:
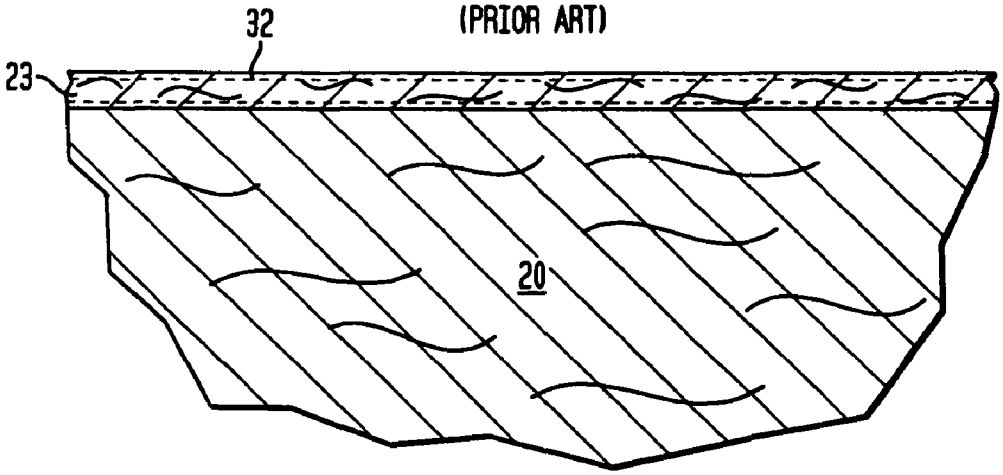
FIG. 3C (PRIOR ART)
Figure 7A:
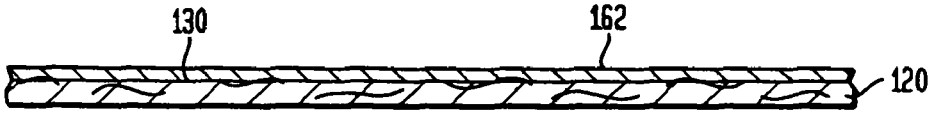
FIGS. 7A-7C show a method of forming a finished edge on the cut pattern piece of FIG. 6, in accordance with certain preferred embodiments of the present invention.
Figure 7B:
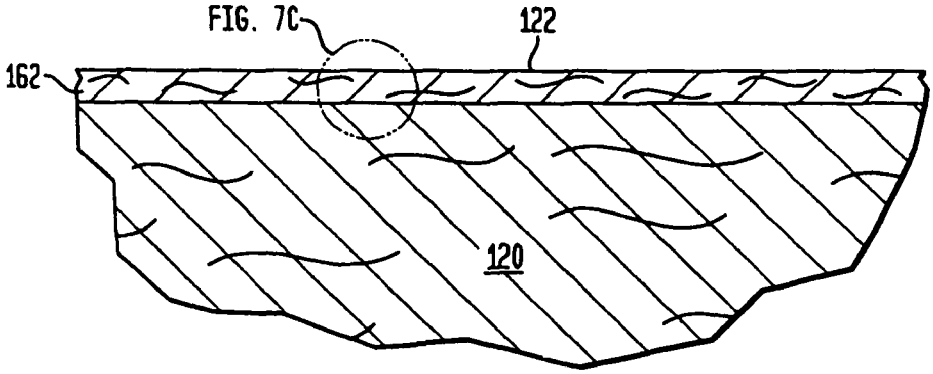
Figure 7C:
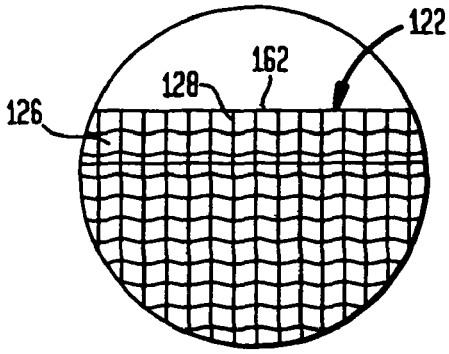

As shown in FIGS. 7A and 7B, the silicone material 162 is deposited in contact with the first surface 130 and the edge 122 of the cut pattern piece. As shown in FIG. 7C, the silicone 162 engages and/or contacts the free ends 128 of the fibers 126. Although the present invention is not limited by any particular theory of operation, it is believed that the silicone 162 at least partially encapsulates and/or contacts to the free ends 128 of the fibers 126 so as to bind the free ends of the fibers to the silicone, which prevents the edge 122 of the pattern piece 120 from fraying or tearing. As a result, the pattern piece does not require a finished edge that includes narrow elastic, trim, lace, folded-over edge or a knitted-in finished edge. Furthermore, a spread 120 is preferably cut into pattern pieces 138A-138L (FIG. 5) before applying the silicone material 162 at the edge 122. The ability to cut the spread into cut pattern pieces before forming the silicone finished edge provides a tremendous cost savings over prior art methods because it improves material yield. Thus, one particular benefit of the present invention is that it provides an increased material yield from fabric spreads. In addition, providing a finished edge of silicone reduces the thickness of the pattern piece at the finished edge. In certain preferred embodiments, the thickness of the finished edge including the silicone bead is 1/16 inch, which is significantly thinner than the prior art finished edges using narrow elastic (FIG. 2*c*), lace, trim or folded-over edges, which provides thicker finished edges of 1/8 inch or greater.

Figure 8A:
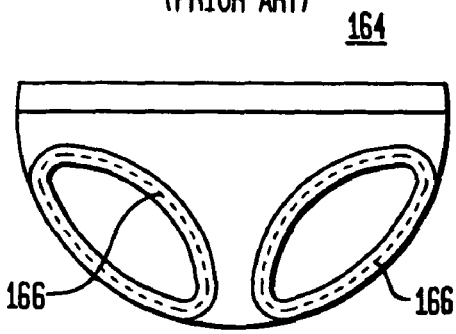
FIG. 8A (PRIOR ART)
FIGS. 8A and 8B show a conventional undergarment having finished edges that are bulky so as to show through outerwear.
Figure 8B:
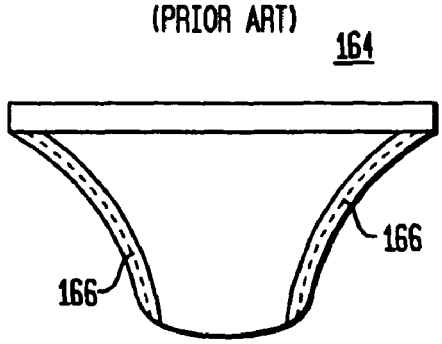
FIG. 8B (PRIOR ART)

FIGS. 8A and 8B show a conventional undergarment 164 having bulky, finished edges 166. Due to the thickness of the bulky edges 166, the undergarment may be visible through outerwear.

Figure 9A:
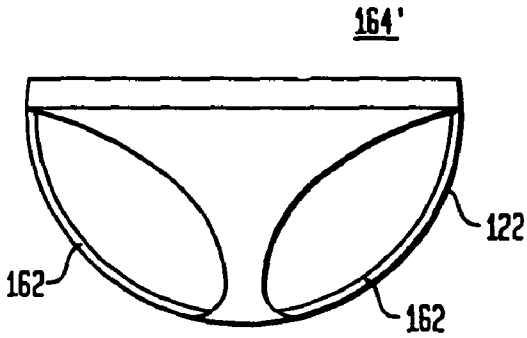
FIGS. 9A and 9B show an undergarment having finished edges including a polymer bead for binding ends of fibers, in accordance with certain preferred embodiments of the present invention.
Figure 9B:
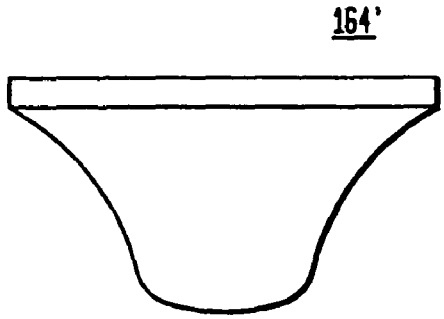

FIGS. 9A and 9B show an undergarment 164' having a silicone finished edge that is made using the inventive process described herein. As shown in FIG. 9A, after a pattern piece has been cut, a silicone material 162 is deposited at the edge 122 of the piece. The combined thickness of the silicone and the fabric is substantially thinner than the thickness of the finished edge 166 shown in the undergarment 164 of FIGS. 8A and 8B. As a result, the undergarment 164' of the present invention does not have a bulky edge that is likely to be visible through outerwear. Thus, the finished edge formed using the present invention is more stretchable and less likely to bind.

Figure 10:
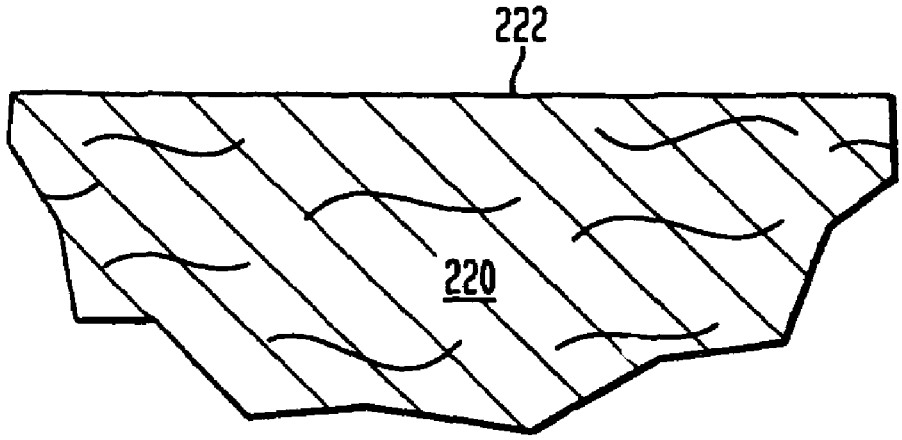
FIG. 10 shows a cut pattern piece having an unfinished edge.
Figure 11:
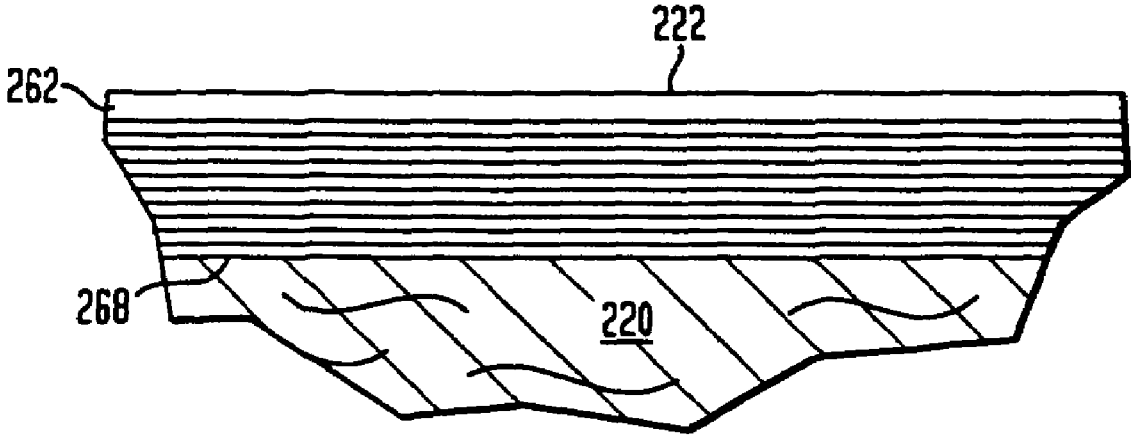
FIG. 11 shows the cut pattern piece of FIG. 10 having a first polymer edge forming a finished edge and second polymer beads forming a gripping surface, in accordance with further preferred embodiments of the present invention.

FIG. 10 shows a cut pattern piece 220 having an edge 222. Although not shown in FIG. 10, the edge 222 includes a plurality of fibers having ends that terminate at the edge 222. On a microscopic scale, the free ends of the fibers at the edge are loose, which makes the edge subject to fray or tear when wearing or washing the piece 220. Referring to FIG. 11, in order to bind the free ends of the fibers, a first bead of silicone material 262 is deposited at the edge 222. The first bead of silicone material 262 preferably contacts and binds the free ends of the fibers at the edge 222 of the pattern piece 220. The pattern piece also has a series of second silicone beads 268 deposited adjacent the first silicone bead 262. The second beads 268 are preferably thinner than the first bead 262 of silicone material. The series of second beads 268 preferably extend parallel to the edge 222 of fabric 220. In other preferred embodiments, the second beads may be remote from an edge and/or may follow a path that is curved, S-shaped, or discontinuous and/or a path that comprises a series of silicone dots.

Figure 12A:
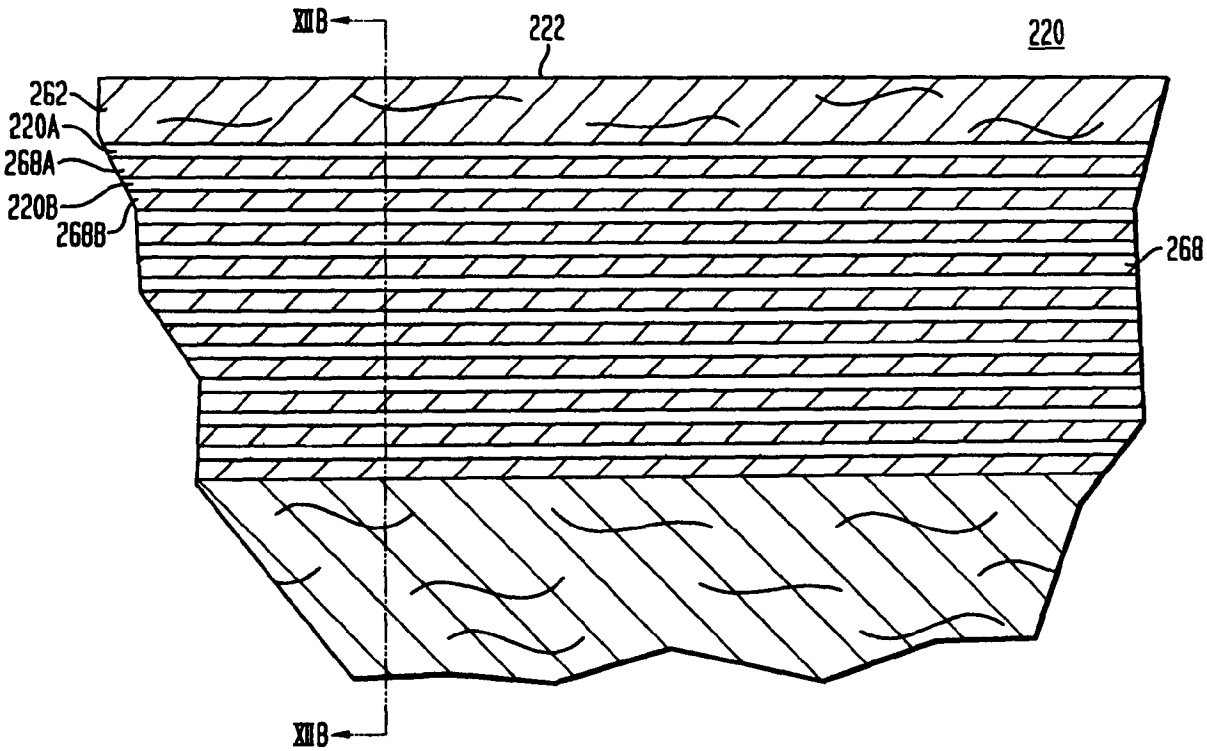
FIG. 12A shows an expanded plan view of the cut pattern piece shown in FIG. 11.

FIG. 12A shows a magnified view of the pattern piece 220 shown in FIG. 11. The pattern piece 220 includes edge 222 having a first silicone bead 262 deposited over the edge for finishing the edge. Although the present invention is not limited by any particular theory of operation, it is believed that the silicone at least partially encapsulates and/or binds the free ends of the fibers to prevent the fibers from fraying and tearing. In addition, a series of second silicone beads 268 extend in a direction generally parallel with the edge 222 of fabric 220. The second silicone beads 268 are spaced apart from one another so that a face of the pattern piece 220 is exposed and/or accessible between the second beads 268. As shown in FIG. 12A, a first one 268A of the second silicone beads is spaced from the first silicone bead 262 so that first fabric section 220A is exposed therebetween. In addition, a second one 268B of the second silicone beads is spaced from the first one 268A of the second silicone beads so that a second fabric section 220B is exposed therebetween. The second silicone beads 268 continue in a similar fashion to provide a silicone web that extends a substantial distance inwardly from edge 222 of pattern piece 220. The density of the silicone web may be modified depending upon the characteristics desired for the underlying pattern piece. If the spacing between the second silicone beads of the web is increased, the pattern piece will be more stretchable and will provide less gripping. If the spacing between the second silicone beads of the web is decreased, the pattern piece will be less stretchable and provide more gripping. The spacing may be modified depending upon the intended use of the garment.

Figure 12B:
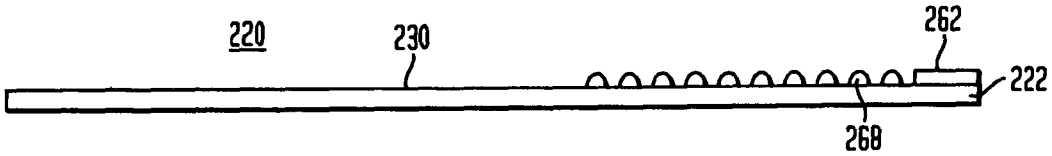
FIG. 12B shows a cross-sectional view of the cut pattern piece of FIG. 12A taken along line 12B-12B thereof.

FIG. 12B shows a magnified view of the pattern piece of FIG. 11. The pattern piece 220 has top surface 230 and outer edge 222. A first silicone bead 262 is deposited over the edge 222 of the pattern piece so as to finish the free ends of the fibers that terminate at the edge of the pattern piece. In addition, the web of second silicone beads 268 is deposited over the first surface 230, adjacent the first silicone bead 262. The second silicone beads 268 are preferably spaced from one another, with portions of the first surface 230 of pattern piece 220 being exposed and accessible through the web of second silicone beads 268. Although the present invention is not limited by any particular theory of operation, it is believed that providing the web of second silicone beads 268 atop the pattern piece 220 (FIGS. 12A and 12B) produces a pattern piece that is less likely to slip or ride-up over a wearer's body. Ride-up may cause an undergarment to bind around a body part, e.g. a leg, which may cause a constricted feeling. Ride-up may also cause bunching of the fabric, which may be visible through outerwear. It is believed that the web of second silicone beads provides the fabric with a gripping feature that prevents the fabric from sliding and riding-up over a wearer's body.

Figure 13:
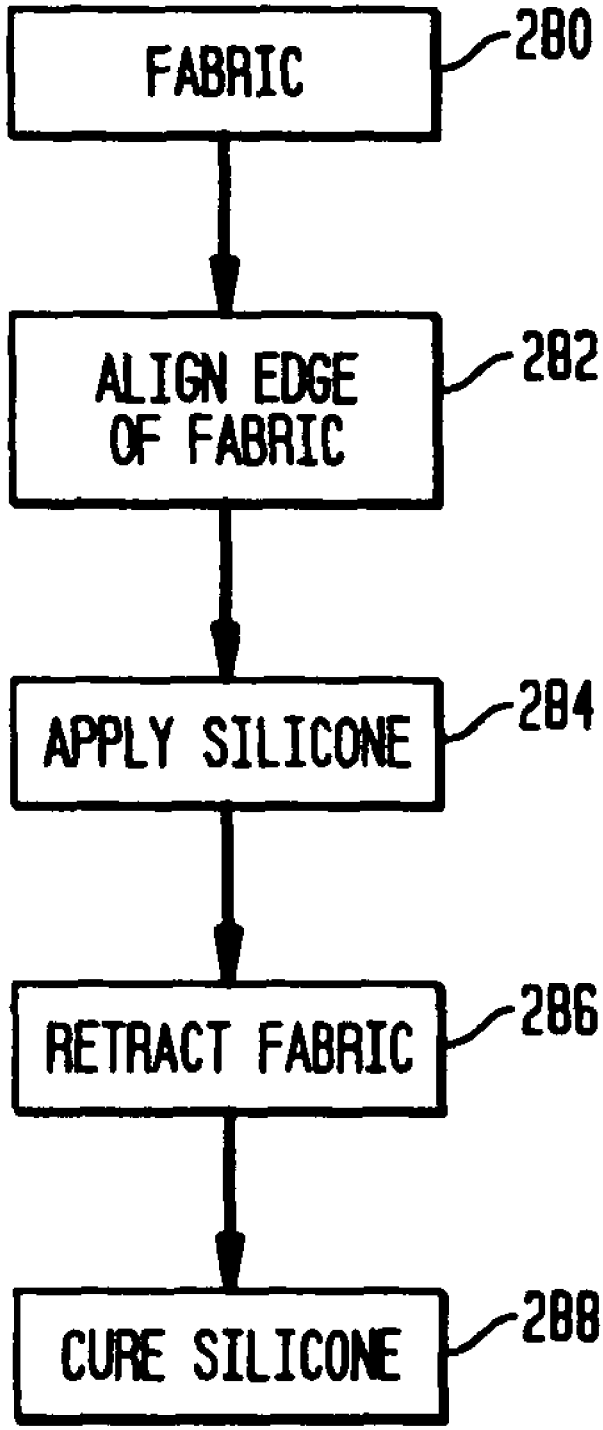
FIG. 13 shows a process for forming a finished edge on a cut pattern piece, in accordance with certain preferred embodiments of the present invention.

FIG. 13 shows a process for providing a finished edge on a cut pattern piece, in accordance with certain preferred embodiments of the present invention. During a first stage 280, a spread of fabric is cut to provide one or more pattern pieces. The pattern piece may be cut by hand or using a computer-assisted cutting instrument. During a second stage 282, an edge of the cut pattern piece is aligned for applying a silicone material over the edge. A straight edge or alignment tool may be used for aligning the edge of the pattern piece. During a third stage 284, the silicone is applied to the edge in an uncured state. Due to the uncured state of the silicone, the silicone tends to at least partially encapsulate and/or bind with the free ends of the fibers at the edge of the pattern piece. The silicone may be applied along a straight edge of a pattern piece or may be applied in a pattern that follows the contour of the edge of the pattern piece, e.g. the silicone may follow the contour of a curved edge. The silicone may also be applied to an interior region of the pattern piece that is remote from an edge. The silicone may be applied along paths that are curved, S-shaped and/or non-continuous (e.g. silicone provided in a dotted pattern). During a fourth stage 286, the pattern piece may be pulled back from the alignment edge and the silicone cured during a fifth curing stage 288. During the curing stage, the silicone may be cured using air or heat.

Figure 14:
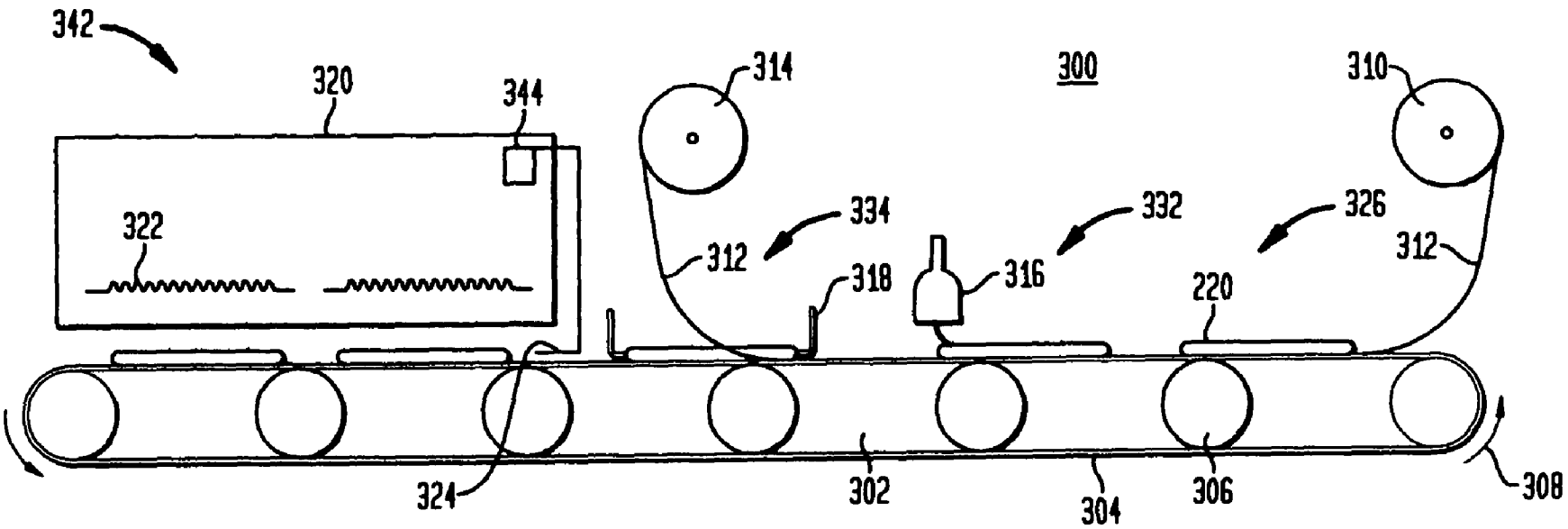
FIG. 14 shows a system for forming a finished edge on cut pattern pieces, in accordance with certain preferred embodiments of the present invention.

FIG. 14 shows a system for producing a finished edge on a cut pattern piece, in accordance with certain preferred embodiments of the present invention. The system 300 includes a conveyor 302 having a belt 304 that is movable over rollers 306. The belt 304 moves over the rollers 306 in the direction indicated by arrow 308. The system includes a paper storage roll 310 from which an absorbent material such as paper 312 is unwound. The absorbent paper 312 is guided into engagement with the conveyor belt 304 so that it is positioned over a top surface of the conveyor belt before a cut pattern piece is positioned on the conveyor belt. The system 300 also includes a second roll 314 that collects the absorbent paper at a point located downstream from the first roll 310.

The system also includes a dispensing head 316 that applies silicone material over a cut pattern piece placed atop conveyor belt 304, and a retractor subassembly 318 that pulls the cut pattern piece off the absorbent paper 312 after the silicone material has been deposited atop the fabric. System 300 also includes a heater 320 having one or more heating coils 322 for heating the silicone applied to the fabric. During the heating process, the heat cures the silicone to permanently bind the silicone to the fabric. The system also includes one or more temperature sensors 324 provided in thermal communication with the top surface of the conveyor belt 304 so as to monitor the surface temperature of the conveyor belt.

Figure 15A:
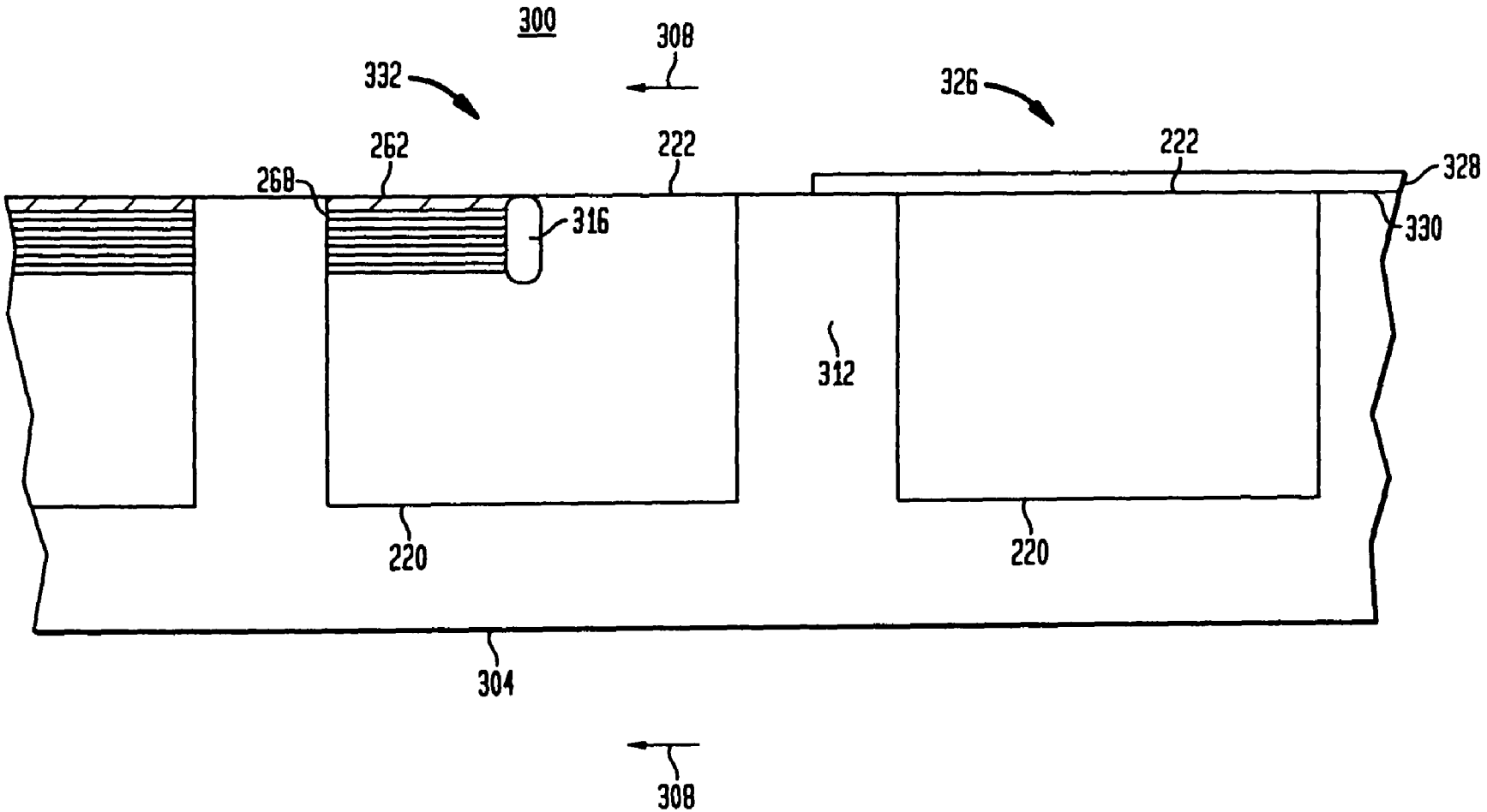
FIG. 15A shows a plan view of first and second stations of the system shown in FIG. 14.

Referring to FIGS. 14 and 15A, the system 300 includes a first stage 326 where cut pattern piece 220 is placed atop absorbent paper 312, with the edge 222 of the piece 220 aligned with a guide having alignment face 330. In other preferred embodiments, the first stage 326 may have alignment fingers that mechanically align the edge of the pattern piece. After the pattern piece has been aligned, the conveyor belt 304 moves the piece 220 downstream in the direction of arrows 308 to a second stage 332 where silicone material is deposited onto the pattern piece 220. At stage 332, a dispenser 316 for silicone dispenses a first silicone bead 262 over the outer edge 222 of the pattern piece 220. Simultaneously, the dispenser 316 deposits a spaced web of second silicone beads 268 over a region of the pattern piece that is inward of the edge 222.

Figure 15B:
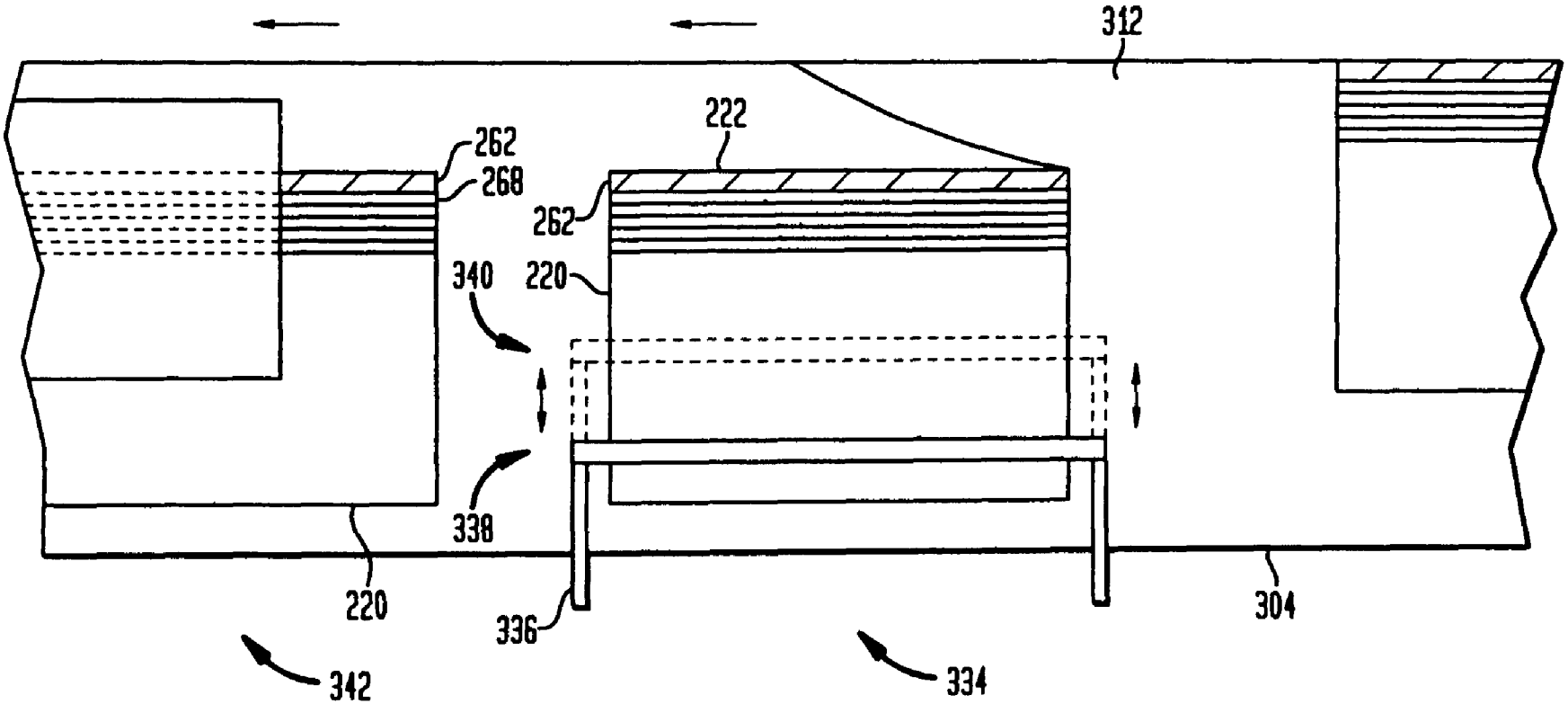
FIG. 15B shows a plan view of third and fourth stations of the system of FIG. 14.

Referring to FIGS. 14 and 15B, conveyor belt 304 continues to move the pattern piece 220 downstream to retractor stage 334. At retracting stage 334, retractor 336 moves from a retracted position 338 to an extended position 340 for engaging a section of pattern piece 220. Once the retractor 336 engages the pattern piece 220, the retractor retracts from position 340 to retracted position 338 to pull the pattern piece 220 off the absorbent paper 312. As the piece 220 is pulled of the paper 312, the first silicone bead 262 at the edge 222 is broken from its engagement with the paper 312 to provide a smooth edge of silicone at the outer edge 222 of the pattern piece 220. Once the piece has been pulled of the paper 312, the pattern piece 220 is moved downstream along conveyor 304 to a curing stage 342. At the curing stage 342, the deposited silicone material is cured using heat. Referring to FIG. 14, the curing stage has a heater 320 having heating coils 322 that produce heat. In preferred embodiments, the heating stage may include six (6) heating stations, each heating station having one or more heating elements. In one particular preferred embodiment, the heating elements are set at 600° F. so that the surface temperature of the conveyor 304 is between 260° F. and 275° F. In highly preferred embodiments, the surface temperature should be between about 268° F.-272° F. The temperature sensor 324 is interconnected with a controller 344 that may change the temperatures of the heating elements 322 depending on ambient conditions. For example, in warmer ambient temperatures, the heating elements 322 may be operated at lower temperatures than would be required under cooler ambient conditions. In certain preferred embodiments, the pattern piece and the silicone deposited on the piece are preferably cured for approximately 30 second to two minutes and more preferably about one minute.

Figure 15C:
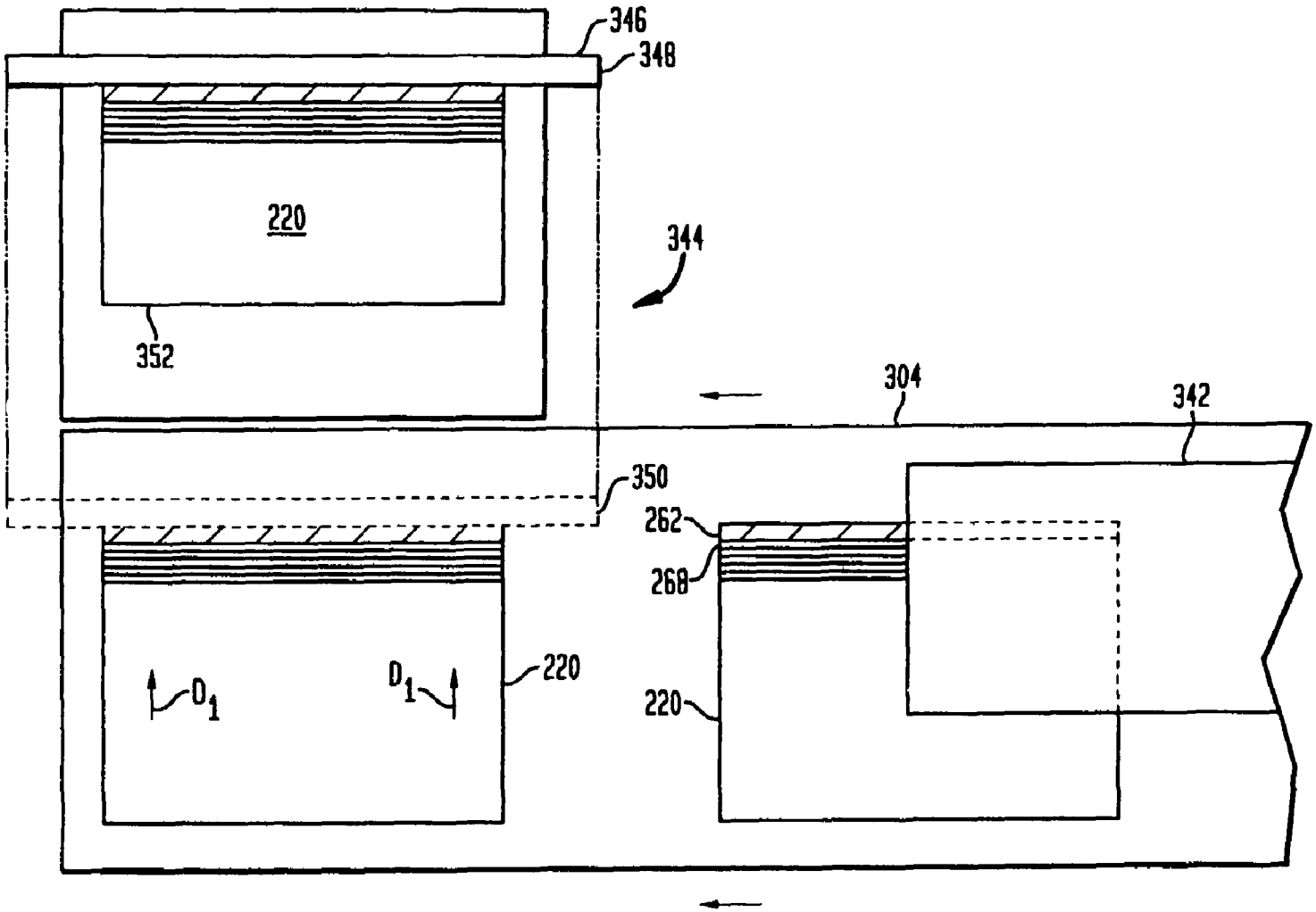
FIG. 15C shows a plan view of fourth and fifth station of the system shown in FIG. 14.

Referring to FIG. 15C, after the pattern piece 220 and the cured silicone 262, 268 exits oven 324, the pattern piece moves downstream along conveyor belt 304 to stacking station 344. At stacking station 344, the pattern piece having the cured silicone is removed from the conveyor 304 by a stacker 346 that is moveable between a first position 348 and a second position 350. In the second position 350, the stacker 346 engages pattern piece 220. The stacker 346 then moves to the first position 348. As the stacker moves between the second and first positions, the pattern piece 320 is moved in the direction $D_1$ for being placed atop a stack 352. After a sufficient number of pattern pieces 220 have been place atop stack 352, the stack may be placed in a package for shipment to another location, i.e. an assembly facility.

Figure 16:
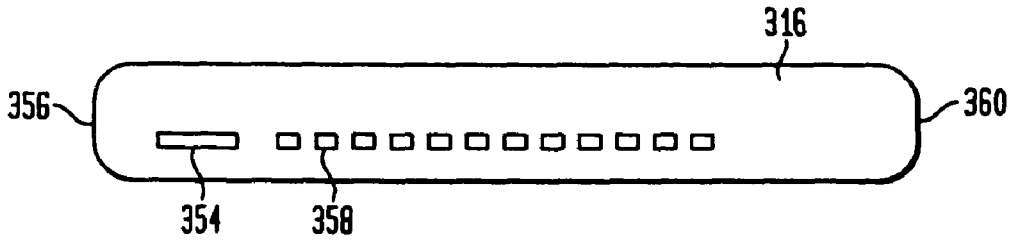
FIG. 16 shows a bottom view of an applicator device used for applying a curable polymer material to a cut pattern piece, in accordance with certain preferred embodiments of the present invention.

FIG. 16 shows a dispenser 316 for silicone, in accordance with certain preferred embodiments of the present invention. A series of openings are provided at the bottom of the dispenser 316. The openings include an elongated opening 354 adjacent the first end 356 of the dispenser and a series of smaller openings 358 that extend between elongated opening 354 and a second end 360 of the dispenser 316. In operation, high pressure is provided inside the dispenser to dispense the silicone material through the openings 354, 358. The openings 354, 358 are preferably arranged along a straight line that extends between the first end 356 and the second end 360 of the dispenser 316.

Figure 17A:
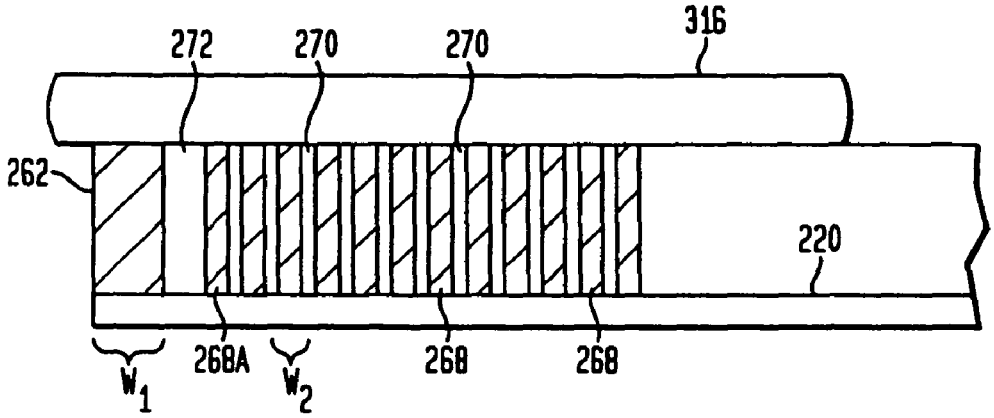
FIG. 17A shows a front elevation view of the applicator device of FIG. 16.

FIG. 17A shows the dispenser 316 depositing silicone onto a cut pattern piece 220. The silicone is dispensed in a pattern that includes thicker first silicone bead 262 deposited at the edge of the pattern piece and a series of smaller second silicone beads 268 that are deposited inwardly from the edge. The second beads 268 are spaced from one another. As shown in FIG. 17A, the first silicone bead 262 has a width $W_1$ that is substantially greater than the width $W_2$ of the second silicone beads 268. In addition, the second silicone beads are spaced from one other so that gaps 270 are present between the second silicone beads. Another gap 272 is present between first silicone bead and a first one of the second silicone beads 268A.

Figure 17B:
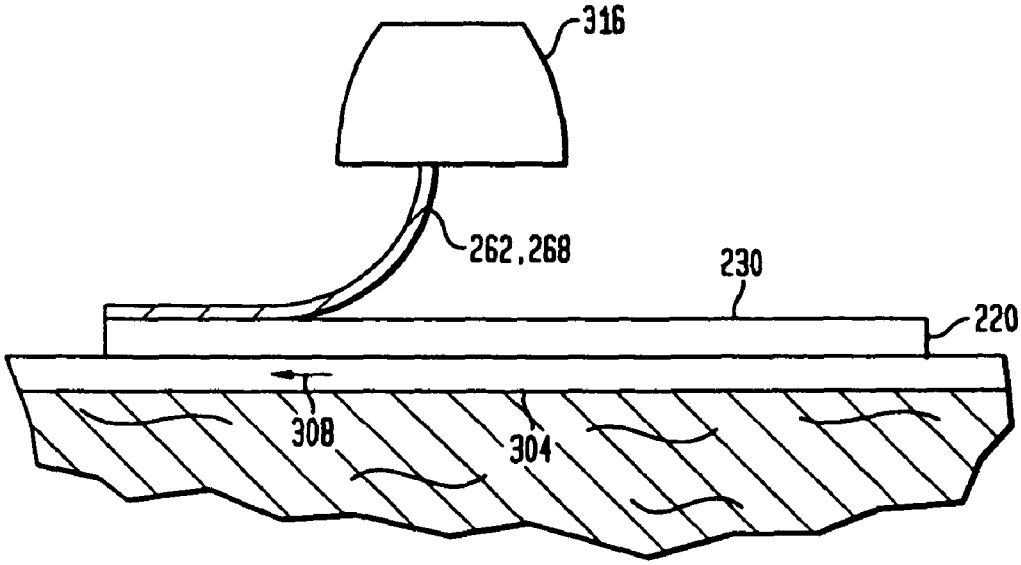
FIG. 17B shows a side elevation view of the applicator device of FIG. 17A.

FIG. 17B shows the dispenser head 316 as the dispenser deposits silicone beads 262, 268 over a top surface 230 of pattern piece 220. The silicone is deposited as the conveyor belt 304 moves fabric 220 in a direction indicated by arrow 308. As the pattern piece 220 passes the dispensing head 316, the silicone material 262, 268 is deposited onto the top surface of the pattern piece 220.

Figure 18:
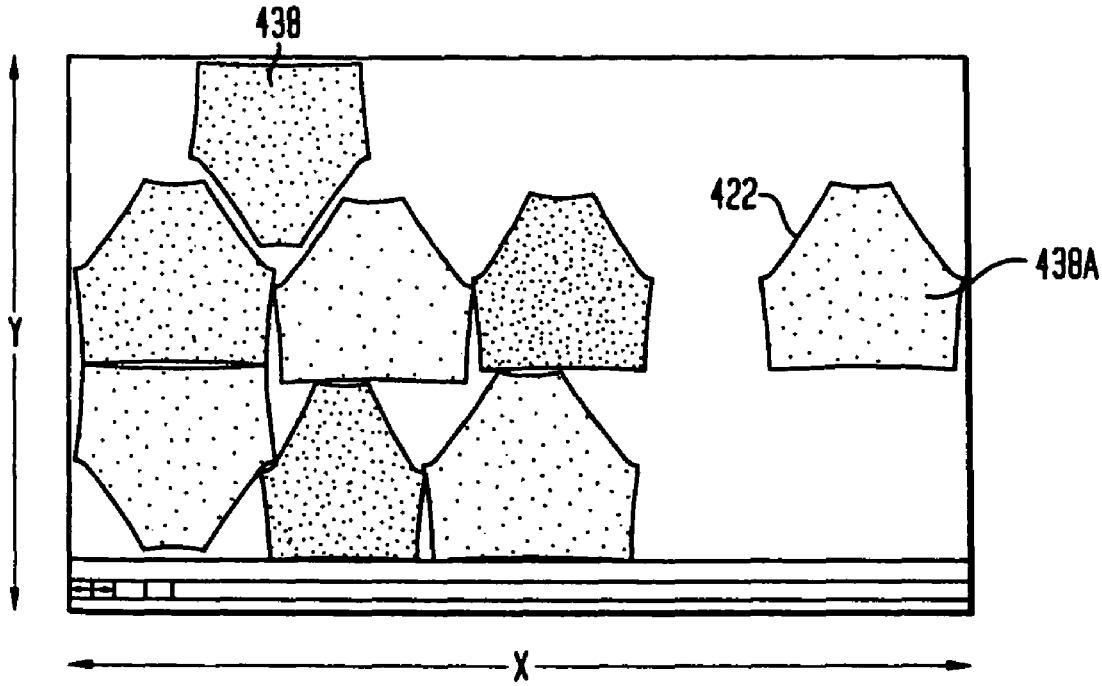
FIG. 18 shows a spread including a stretchable fabric having a first direction of stretch, in accordance with certain preferred embodiments of the present invention.
Figure 19:
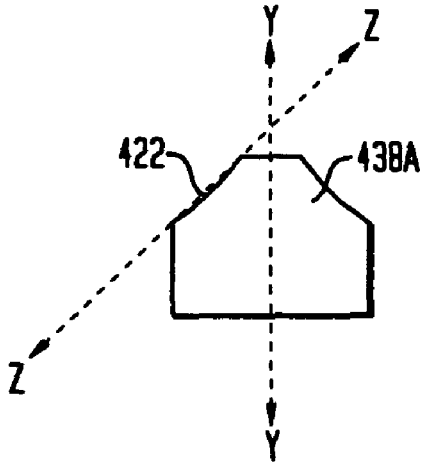
FIG. 19 shows a pattern piece cut from the spread of FIG. 18.

In another preferred embodiment of the present invention, a spread is made of stretchable fabric. Referring to FIG. 18, the spread 420 is more stretchable in a first axial direction designated Y than a second axial direction designated X. Pattern pieces 438 are cut from the spread 420. Referring to FIGS. 18 and 19, at least one of the cut pattern pieces 438A has a first unfinished edge 422 that extends in a third axial direct designated Z that traverses or crosses the first axial direction Y. The direction of the unfinished edge 422 can be readily modified depending upon adjustability and fit requirements. A curable polymer such as silicone is disposed over the first unfinished edge 422 for engaging free ends of fibers at the edge 422. The polymer is then cured for binding the free ends of the fibers and finishing the edge.

Although the present invention is not limited by any particular theory of operation, it is believed that the stretch characteristics of fabric may be used to provide garments having more adjustability and better fit. Thus, in one embodiment, an edge may be cut that extends in a direction parallel to the direction of stretch of the fabric. In another embodiment, an edge may be cut that extends in a direction perpendicular to the direction of stretch of the fabric. In still another embodiment, an edge may be cut that extends in a direction that crosses the direction of stretch of the fabric. Thus, the direction of the cut edge may be readily modified based upon the use to which the cut pattern piece will be put.

Although the invention herein has been described with reference to particular embodiments, it is to be understood that these embodiments are merely illustrative of the principles and applications of the present invention. It is therefore contemplated that numerous modifications may be made to the illustrated embodiments and that other arrangements may be made without departing from the spirit and scope of the present invention as defined by the appended claims.

The invention claimed is:

1. A garment having a finished edge, said garment comprising a fabric having a cut edge and a plurality of fibers having free ends that terminate at the edge wherein the free ends of the fibers renders the cut edge susceptible to fraying and tearing; and a first bead of a polymer material applied continuously along the cut edge, wherein said first bead of a polymer material provides an unopposed, finished edge that is stretchable for adjusting to movement of said piece of fabric and renders the cut edge less susceptible to fraying and tearing.

2. The garment fabric as claimed in claim 1, further comprising a plurality of second beads of a polymer material provided on said garment fabric so that said first bead is interposed between said second beads and said cut edge, wherein said second beads are spaced from one another on said garment fabric so that said garment fabric is exposed between said second beads.

3. The garment fabric as claimed in claim 2, wherein said second beads are narrower than said first bead.

4. The garment fabric as claimed in claim 1, wherein said garment fabric is part of a garment selected from the group consisting of undergarments, activewear, shapewear, bathing suits, garments having support panels, and garments using compression fabric.

5. The garment fabric as claimed in claim 4, wherein said garment includes a waist section and leg openings and wherein said first bead forms the finished edge of at least one of said leg openings and said waist section.

6. A garment comprising:

at least one piece of fabric that forms said garment;

said garment having leg openings;

said fabric including cut edges that surround the leg openings;

a continuous bead of a cured polymer proximate to the entirety of at least one of the cut edges surrounding the leg openings, wherein the cured polymer bead forms a finished edge that is stretchable for adjusting to movement of said fabric and that is devoid of any of a folded-over edge, a narrow elastic trim or lace, and a knitted-in edge; and a plurality of second beads of a cured polymer material provided on said piece of fabric adjacent said bead of a cured polymer material wherein said bead of cured polymer that finishes the cut edge is interposed between the plurality of second beads and the cut edge of said piece of fabric wherein said second beads are spaced from one another on said garment fabric so that said garment fabric is exposed between said second beads and wherein said second beads are narrower than said first bead.

7. The garment of claim 6 wherein said first bead of a polymer material provides an unopposed edge that renders the cut edge less susceptible to fraying and tearing.

8. The garment of claim 6, wherein said garment is selected from the group consisting of undergarments, activewear, shapewear, bathing suits, garments having support panels, and garments using compression fabric.

9. The garment of claim 6, wherein said bead of a cured polymer material comprises silicone.

10. The garment of claim 6, wherein said plurality of second beads of a cured polymer material comprises silicone.

11. The garment of claim 6, wherein said fabric includes fibers selected from the group consisting of natural fibers, cotton fibers, synthetic fibers, nylon fibers, polyester fibers and spandex fibers.

* * * * *

UNITED STATES PATENT AND TRADEMARK OFFICE

CERTIFICATE OF CORRECTION

PATENT NO. : 8,215,251 B2
APPLICATION NO. : 12/221516
DATED : July 10, 2012
INVENTOR(S) : David Welsch, Anthony Angelino and Ronald Boser It is certified that error appears in the above-identified patent and that said Letters Patent is hereby corrected as shown below:

In the Specification
Column 1, line 22, “forms” should read --form--.
Column 1, line 29, “folded over” should read --folded-over--.
Column 2, line 10, “ride-up” should read --ride up--.
Column 2, line 47, “ride-up” should read --ride up--.
Column 5, line 2, insert a --,-- after the word --includes--.
Column 7, line 52, “used” should read --use--.
Column 8, line 37, “station” should read --stations--.
Column 9, line 34, delete the word “to”.
Column 10, line 66, “ride-up” should read --ride up--.
Column 11, line 5, “riding-up” should read --riding up--.
Column 12, line 11, “of” should read --off--.
Column 12, line 15, “of” should read --off--.
Column 12, line 37, “exits” should read --exit--.

In the Claims
Column 13, line 54, “renders” should read --render--.

Signed and Sealed this
Fourth Day of February, 2014

Michelle K. Lee

Michelle K. Lee
*Deputy Director of the United States Patent and Trademark Office*